US006591848B2

(12) United States Patent
Ma

(10) Patent No.: US 6,591,848 B2
(45) Date of Patent: Jul. 15, 2003

(54) RATCHET BASED CONTROL DEVICE OF LARGE-SIZED PARASOL

(76) Inventor: Mark Joen Shen Ma, 12F, No. 578, GuangFu South Road, Taipei (TW)

( * ) Notice: Subject to any disclaimer, the term of this patent is extended or adjusted under 35 U.S.C. 154(b) by 0 days.

(21) Appl. No.: 09/908,974

(22) Filed: Jul. 20, 2001

(65) Prior Publication Data

US 2003/0015229 A1 Jan. 23, 2003

(51) Int. Cl.[7] ..... A45B 3/00

(52) U.S. Cl. ..... 135/22; 135/16; 135/20.3; 135/28

(58) Field of Search ..... 135/22, 15.1, 20.3, 135/40, 16, 28; 242/395, 396.4, 396.2, 306, 389; 248/328, 329, 330.1, 338

(56) References Cited

U.S. PATENT DOCUMENTS

| | | | | | |
|---|---|---|---|---|---|
| 3,175,568 | A | * | 3/1965 | Kafka | 135/20.3 |
| 4,386,621 | A | * | 6/1983 | Redl | 135/20.3 |
| 4,674,522 | A | * | 6/1987 | Ma | 135/20.3 |
| 4,877,045 | A | * | 10/1989 | Lin | 135/20.3 |
| 4,878,509 | A | * | 11/1989 | Tung | 135/20.3 |
| 5,711,333 | A | * | 1/1998 | Vanderminden, Sr. | 135/20.3 |
| 5,845,665 | A | * | 12/1998 | Koehn | 135/98 |
| 6,182,917 | B1 | * | 2/2001 | Lai | 242/390.8 |
| 6,196,242 | B1 | * | 3/2001 | Xu | 135/20.1 |
| 6,196,489 | B1 | * | 3/2001 | Ma | 242/396.2 |
| 6,230,724 | B1 | * | 5/2001 | Lai | 135/20.3 |
| 2002/0092550 | A1 | * | 7/2002 | Chang | 135/20.3 |

* cited by examiner

*Primary Examiner*—Daniel P. Stodola
*Assistant Examiner*—Jennifer E. Novosad
(74) *Attorney, Agent, or Firm*—Rosenberg, Klein & Lee

(57) ABSTRACT

A parasol control device includes a shaft rotatably received in aligned holes defined in a central rod of the parasol. A handle is coupled to a first end of the shaft for manually rotating the shaft. A rope is fastened to the shaft whereby when the shaft is rotated, the rope is wound to/unwound from the shaft for opening/closing the parasol. A ratchet wheel defines a central bore tightly fit over the shaft whereby a friction is present between the ratchet wheel and the shaft. A block is attached to the rod and defines a bore for rotatably supporting the shaft. A blind hole is defined in the block with a spring biased pin received in the blind hole. A free end of the pin engages with the teeth of the ratchet for generating consecutive impact sounds when the shaft is rotated in a first direction to open the parasol. When the shaft is rotated in an opposite second direction to close the parasol, the ratchet wheel is prevented from rotation by the pin. With a sufficient large torque applied to the shaft, the friction is overcome and the shaft is rotated in the second direction to release the rope for closing the parasol.

5 Claims, 4 Drawing Sheets

RATCHET BASED CONTROL DEVICE OF LARGE-SIZED PARASOL

FIELD OF THE INVENTION

The present invention generally relates to a large-sized parasol, such as a beach parasol and a garden parasol, and in particular to a ratchet based control mechanism for opening/closing the large-sized parasol.

BACKGROUND OF THE INVENTION

Large-sized umbrellas or parasols, such as garden parasols and beach parasols, are usually equipped with a handle or handwheel for operating a rope-based driving mechanism to open/close a canopy of the parasol. The large-sized parasol usually comprises a central rod along which a runner is movably mounted. A crown is attached to a top end of the central rod. Ribs extend from the crown for supporting the canopy. Stretchers extend from the runner and pivoted to the ribs whereby by moving the runner along the central rod, the ribs are caused to move toward/away from the central rod and thus opening/closing the canopy. A rope that is manually wound/unwound by means of the handle has an end attached to the runner whereby winding/unwinding the rope moves the runner along the central rod.

For the large-sized parasols, the torque required to rotate the handle is quite large, causing manual operation thereof to be difficult. A disadvantage is that during the process of winding the rope to open the canopy, an operator must from time to time maintain the required torque to ensure smooth opening of the parasol. Devices for temporarily retaining the rope during the winding process are available in the market. Such devices allow an operator to be temporarily released from maintaining the required torque by himself or herself. However, such devices are very complicated and thus expensive. In addition, such devices are not able to provide a stepwise operation which ensures proper progress of winding the rope by the operator.

It is thus desirable to provide a large-sized parasol having a stepwise control device for winding/unwinding a rope thereof in order to overcome the above discussed problems.

SUMMARY OF THE INVENTION

Accordingly, an object of the present invention is to provide a control device for opening/closing a large-sized parasol, the device comprising a ratchet based mechanism consisting of a ratchet wheel and a pin cooperating with ratchet wheel to control the opening/closing operation in a stepwise fashion.

Another object of the present invention is to provide a control device for a large-sized parasol comprising a mechanism for generating consecutive impact sounds during opening the parasol for indication of proper operation.

A further object of the present invention is to provide a control mechanism for opening/closing a large-sized parasol, the control mechanism having a simple structure and thus low costs.

To achieve the above objects, in accordance with the present invention, there is provided a parasol control mechanism comprising a shaft rotatably received in aligned holes defined in a central rod of the parasol. A handle is coupled to a first end of the shaft for manually rotating the shaft. A rope is fastened to the shaft whereby when the shaft is rotated, the rope is wound to/unwound from the shaft for opening/closing the parasol. A ratchet wheel defines a central bore tightly fit over the shaft whereby a friction is present between the ratchet wheel and the shaft. A block is attached to the rod and defines a bore for rotatably supporting the shaft. A blind hole is defined in the block with a spring biased pin received in the blind hole. A free end of the pin engages with the teeth of the ratchet for generating consecutive impact sounds when the shaft is rotated in a first direction to open the parasol. When the shaft is rotated in an opposite second direction to close the parasol, the ratchet wheel is prevented from rotation by the pin. With a sufficient large torque applied to the shaft, the friction is overcome and the shaft is rotated in the second direction to release the rope for closing the parasol.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
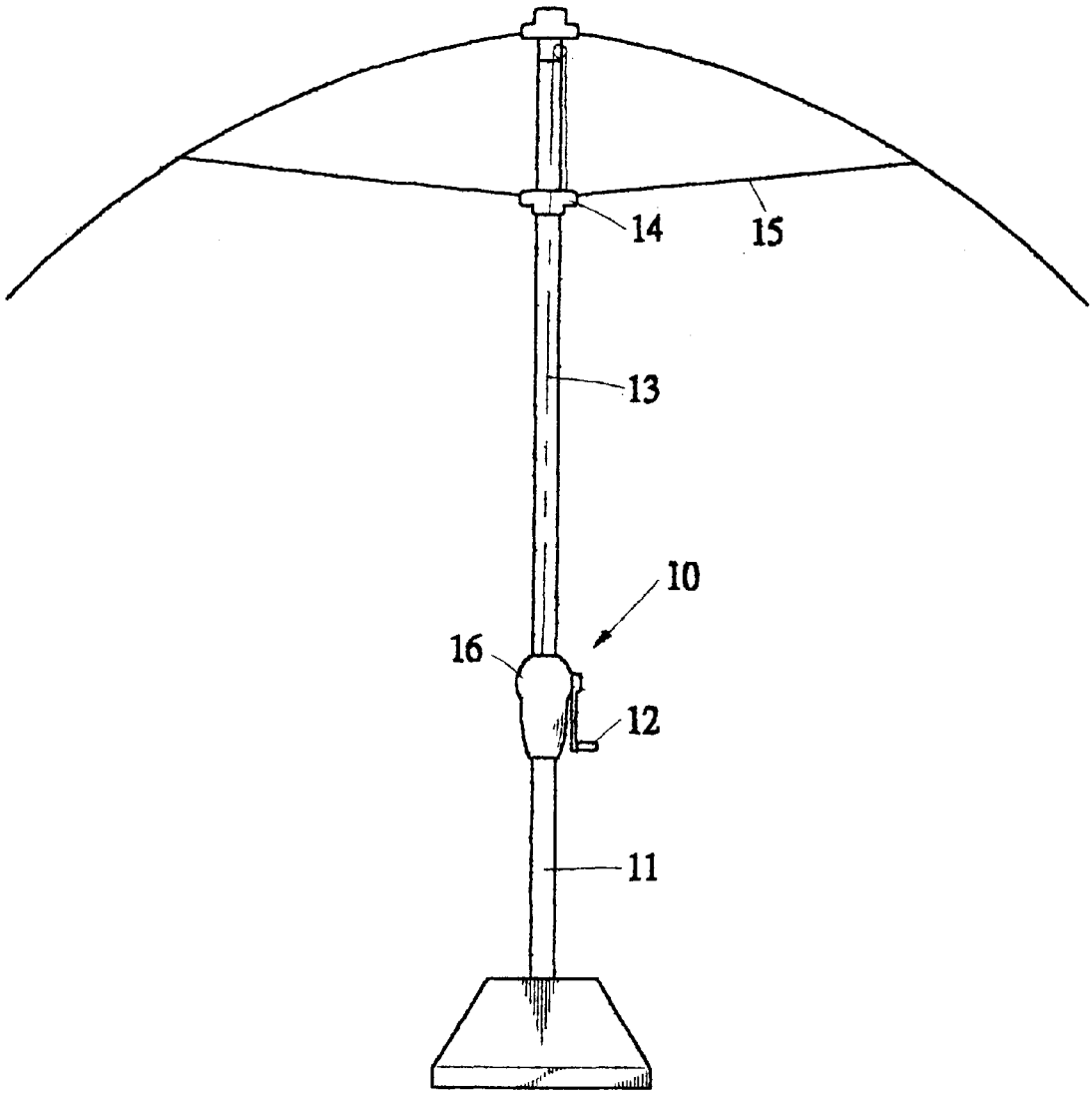
FIG. 1 is a schematic side elevational view of a large-sized parasol constructed in accordance with the present invention with a canopy removed for simplification purposes.

With reference to the drawings and in particular to FIG. 1, a parasol constructed in accordance with the present invention comprises an elongated, upright, tubular central rod 11 having a lower end mounted to a base (not labeled) and an upper end to which a crown (not shown) in mounted. A plurality of ribs (not labeled) is pivotally mounted to and radially extends from the crown. A runner 14 is movably mounted to the central rod 11 to be movable toward/away from the crown. A stretcher 15 is pivotally mounted between each rib and the runner 14. A rope 13 has a major portion received in and extending along the central rod 11 with an end portion extending out of the rod 11 and attached to the runner 14 whereby by pulling/releasing the rope 13, the runner 14 is driven along the rod 11 to open/close the parasol.

Figure 2:
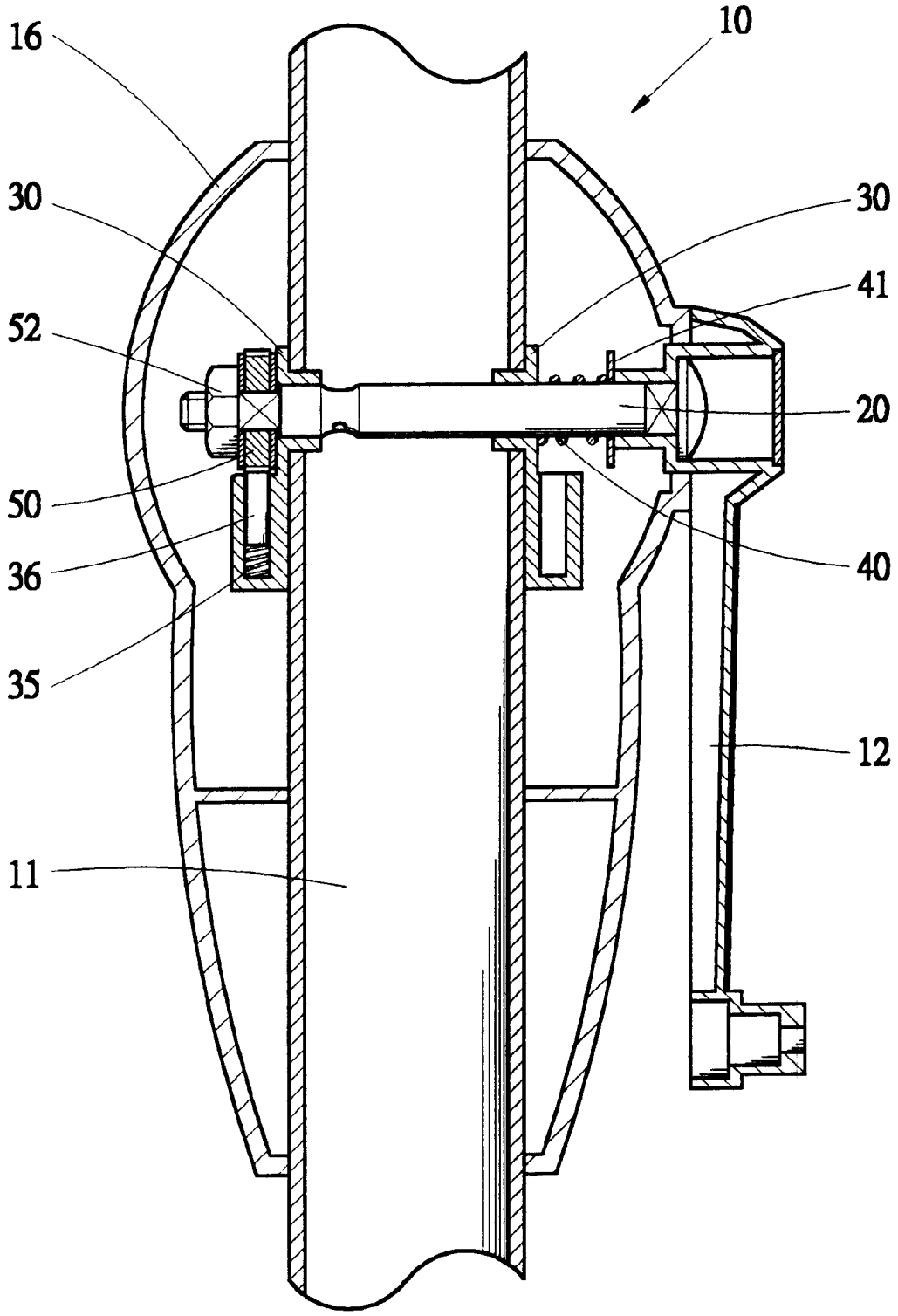
FIG. 2 is a cross-sectional view of a portion of the large-sized parasol of the present invention showing a stepwise control device in accordance with a preferred embodiment of the present invention.
Figure 3:
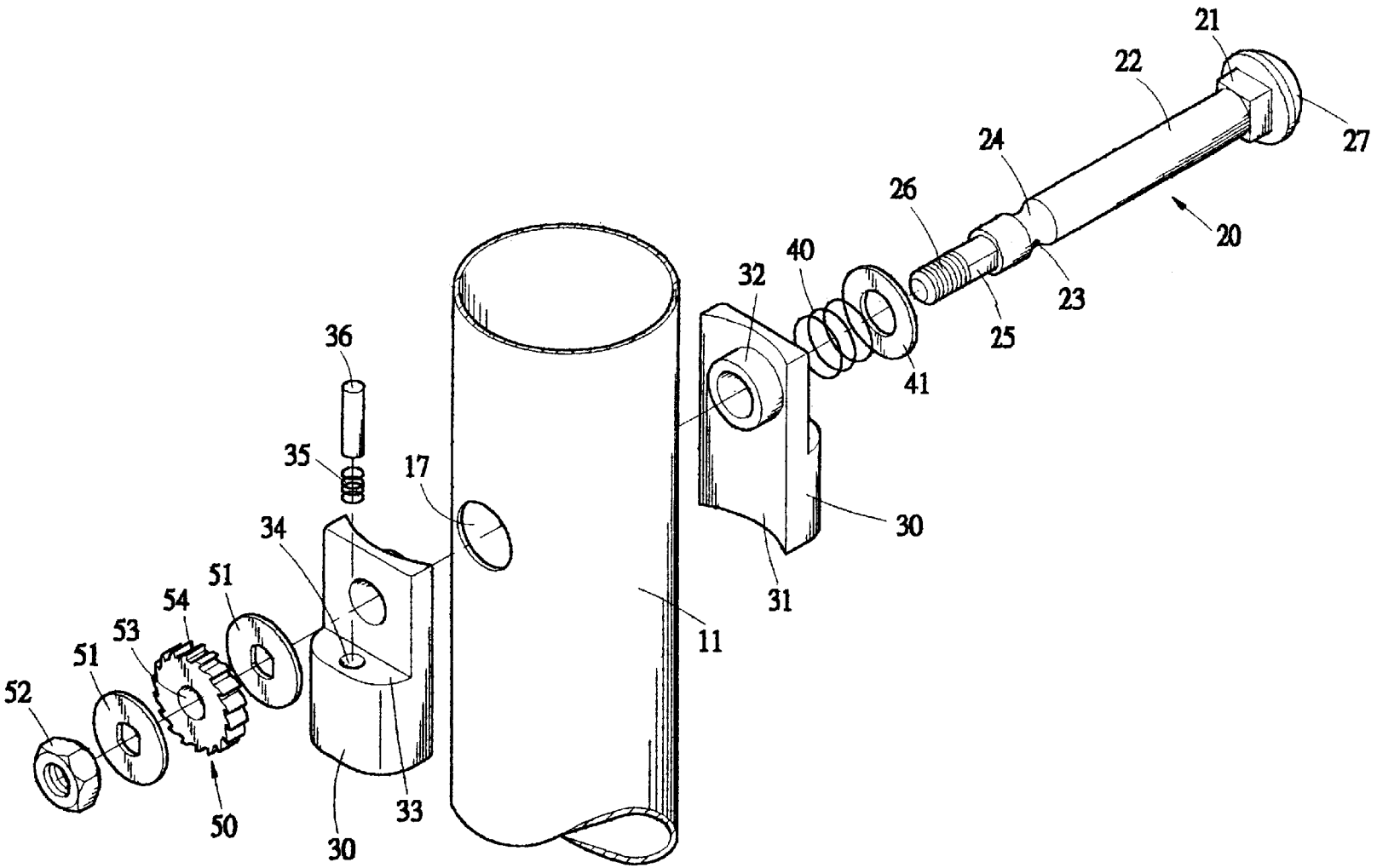
FIG. 3 is an exploded view of FIG. 2.

Also referring to FIGS. 2 and 3, a stepwise control device 10 is mounted to the rod 11 and coupled to the rope 13 for pulling/releasing the rope 13. The control device 10 comprises a shaft 20 extending, in a lateral direction with respect to the rod 12, through and rotatably supported by aligned holes 17 defined in rod 12. The shaft 20 has a first end 27 that is expanded. A driving section 21 having a square cross section is formed next to the expanded end 27. A cylindrical section 22 extends from the driving section 21 to a second end 26 of the shaft 17. Threading is formed on the second end 26. A circumferential groove 24 having a semi-circular cross section is formed in the cylindrical section 22 with a hole 23 defined in the groove 24. The shaft 20 forms a retaining section 25 next to the threaded second end 26.

A handle 12 has an end defining a square hole (not labeled) snugly fit over and retained by the driving section 21 of the shaft 20 whereby a driving coupling is formed between the handle 12 and the shaft 20. The shaft 20 can thus be rotated by the handle 12. The handle 12 is kept in position by the expanded end 27 of the shaft 20. A spring 40 surrounds the cylindrical section 22 of the shaft 20 with ends engaging the rod 11 and the shaft 20. In the embodiment illustrated, a washer 41 is fit on the shaft 20 interposed between the spring 40 and an inward-extending portion (not labeled) of the handle 12 for biasing the shaft 20 and the handle 12 with respect to the rod 11.

Two blocks 30 are disposed on opposite sides of the rod 11 corresponding to the holes 17. Each block 30 forms an inward projection 32 snugly received in the corresponding hole 17. A bore (not labeled) is defined in the projection 32 of each block 30 for receiving and rotatably supporting the shaft 20. Each block 30 forms a raised section (not labeled) forming a shoulder 33. A blind hole 34 is defined in the raised section and exposed to the surface of the shoulder 33. A pin 36 is received in the blind hole 34 and biased by a spring 35 to have a free end of the in 36 projecting out of the blind hole 34. Preferably, each block 30 has a curved surface 31 conforming with the rod 11.

A ratchet wheel 50 defines a central bore 53 fit over and retained in the retaining section 25 of the shaft 20 whereby the pin 36, serving as a ratchet, engages teeth 54 of the ratchet wheel 50. Preferably two washers 51 are arranged on both sides of the ratchet wheel 50. The bore 53 is dimensioned so that the ratchet wheel 50 is tightly fit over the retaining section 25 with a predetermined amount of friction present between the retaining section 25 and the bore 53 whereby the ratchet wheel 50 is rotatable in unison with the shaft 20. However, when a sufficient amount of resistance that is greater than the friction, is applied to the ratchet wheel 50 during the rotation of the shaft 20, the shaft 20 is allowed to rotate with respect to the ratchet wheel 50. A nut 52 engages the threaded end 26 of the shaft 20 for securing the ratchet wheel 50 on the shaft 20 and causing compression of the spring 40. The biasing force of spring 40 secures the blocks 30 and ratchet wheel 50 in position.

If desired, a casing 16 is provided to house the control device 10.

The rope 13 has an inner end portion fastened to the shaft 20 through the hole 23 whereby when the shaft 20 is rotated, the rope 13 is wound to and/or unwound from the cylindrical section 22 of the shaft 20 for moving the runner 14 to open and/or close the parasol.

To open the parasol, a user rotates the shaft 20 in a first direction via the handle 12 to wind the rope 13 to the shaft 20. In the opening operation, the ratchet wheel 50 is rotated with the shaft 20 due to the friction therebetween. When the ratchet wheel 50 rotates, the free end of the pin 36 that is biased by the spring 35 hits the teeth 54 one by one and consecutively, causing successive impact sounds to indicate the operation of the control device 10. When the user releases the handle 12, due to gravity, the parasol intends to close itself, causing the shaft 20 to rotate in an opposite second direction. Such a rotation in the second direction is stopped by the engagement between the pin 36 and the teeth 54 of the ratchet wheel 50. This allows the user to open the parasol to any desired extent and keeps the parasol at such an open condition.

To close the parasol, the user forcibly rotate the shaft 20 in the second direction so as to overcome the friction between the ratchet wheel 50 and the shaft 20 whereby the shaft 20 is allowed to rotate with respect to the ratchet wheel 50. The rope 13 is thus allowed to unwind from the shaft 20 without being confined by the engagement between the pin 36 and the ratchet wheel 50.

Figure 4:
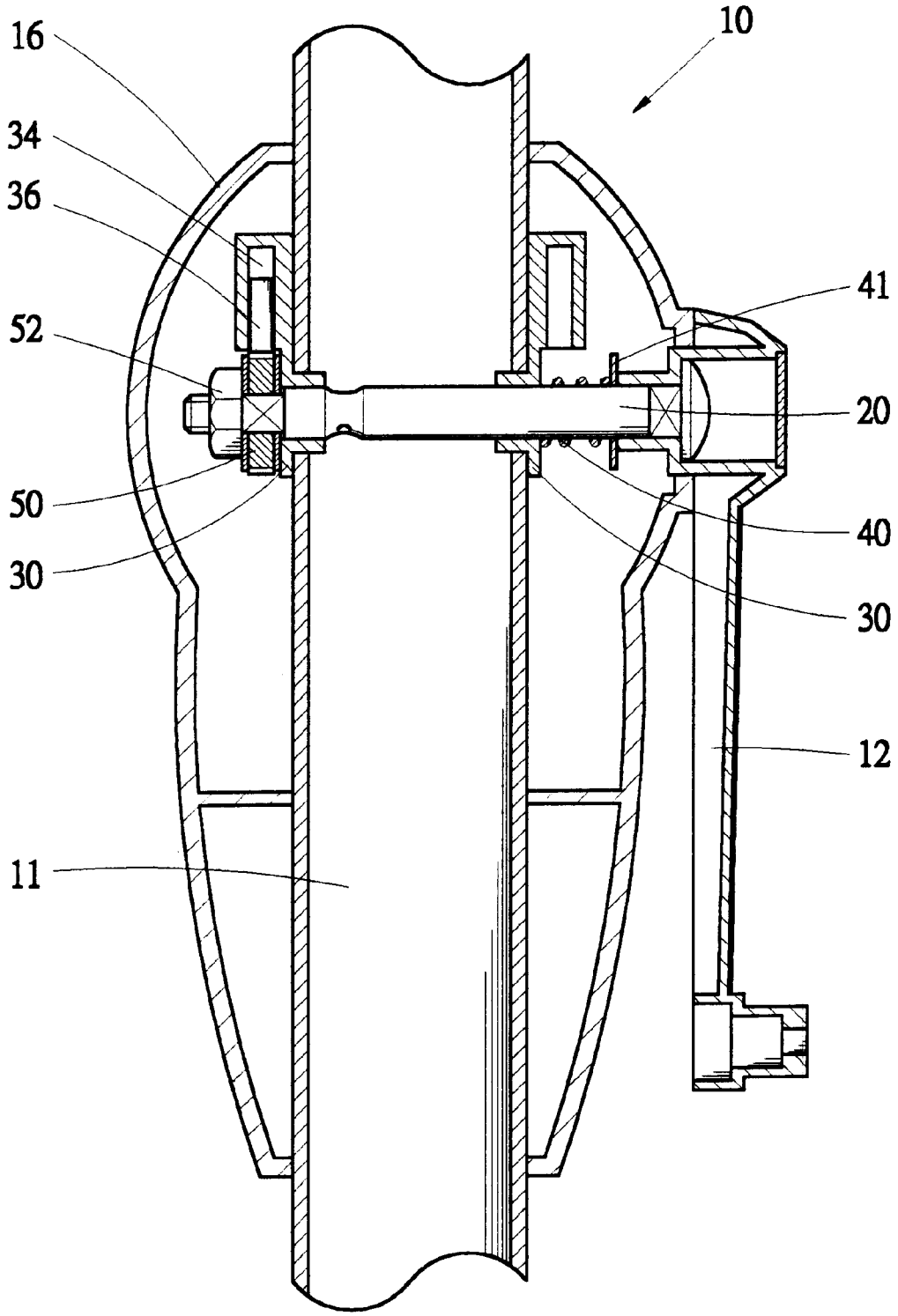
FIG. 4 is similar to FIG. 3 but showing another embodiment of the stepwise control device of the present invention.

FIG. 4 shows another embodiment of the present invention which is substantially identical to the embodiment shown in FIGS. 2 and 3. To simplify the description and illustration, elements of FIG. 4 having the same function as those of FIGS. 2 and 3 bear the same reference numerals. In the embodiment of FIG. 4, the blocks 30 are arranged in such a way that the pin 36 that is movably received in the blind hole 34 of the block 30 is allowed to slide off the blind hole 34 by means of gravity. In other words, the blind hole 34 is arranged in a vertically downward direction whereby the pin 36 may be caused by the gravity to slide off the hole 34. The pin 36 has a lower free end (not labeled) engaging the teeth 54 of the ratchet 50 for performing the same function of the pin 36 of FIGS. 2 and 3. The remaining description of the embodiment of FIG. 4 is substantially the same as that of the embodiment of FIGS. 2 and 3. Thus, no further detail is needed herein.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A control device for a parasol, comprising:

a longitudinally directed hollow rod with a pair of holes formed through a wall thereof, said pair of holes being axially in alignment and having an axis defining a substantially horizontal axis;

a shaft extending in a lateral direction passing through said pair of holes in said rod and rotatably supported thereby, said shaft having a hole passing therethrough for fastening one end of a rope located within said rod to the shaft whereby rotation of the shaft causes said rope to be wound or unwound from the shaft, thereby respectively pulling or releasing said rope extending upward within said rod so as to effect respectively opening of closing of the parasol;

a ratchet wheel having teeth fitted over a retaining section of the shaft whereby rotation of the shaft in a first direction effects rotation of said ratchet wheel in unison therewith;

at least one block having a surface substantially conforming to the outer surface of said rod, said block having a cylindrical projection extending from said surface into one of said pair of holes, a bore being defined in said projection for rotatably receiving said shaft, said block having a blind hole formed therein receiving a pin, a biasing element being located between said pin and said blind hole for biasing a free end of the pin to engage the teeth of said ratchet wheel.

2. The control device as claimed in claim 1, wherein the shaft comprises a driving section having a substantially square cross-sectional area for insertion through a substantially square hole formed in a handle whereby the shaft is drivingly coupled to the handle.

3. The control device as claimed in claim 1, wherein the shaft has an expanded end for retaining a handle and an opposing threaded end for threaded engagement of a nut, a spring being mounted between the expanded end of the shaft and said rod of the parasol for biasing the shaft in conjunction with the nut so as to retain the handle and the ratchet wheel in aligned position.

4. The control device as claimed in claim 1, wherein the ratchet wheel defines a central bore having a dimension for frictionally engaging the retaining section of the shaft for permitting rotation of the ratchet wheel in said first direction.

5. The control device as claimed in claim 4, wherein the frictional engagement permits the shaft to be rotatable with respect to the ratchet wheel when the shaft is rotated in a second direction opposing said first direction whereby the ratchet wheel is prevented from rotating through interface with the pin.

* * * * *